US005623975A

United States Patent [19]

Simson

[11] Patent Number: 5,623,975

[45] Date of Patent: Apr. 29, 1997

[54] GAS CAPSULE FILLING AND SEALING PROCESS

[76] Inventor: Anton K. Simson, 13227 Aubrey St., Poway, Calif. 92064

[21] Appl. No.: 380,691

[22] Filed: Jan. 30, 1995

[51] Int. Cl.[6] ..... B65B 31/00

[52] U.S. Cl. ..... 141/51; 114/114; 114/350; 114/378; 53/86; 53/109; 53/403

[58] Field of Search ..... 141/4, 46, 50, 141/51, 52, 63, 114, 313, 318, 329, 348–350, 369, 378, 347, 20; 53/86, 89–96, 109, 403, 468, 469, 381.4; 600/21

[56] References Cited

U.S. PATENT DOCUMENTS

| | | | |
|---|---|---|---|
| 2,477,406 | 7/1949 | Church | 141/51 |
| 3,187,787 | 6/1965 | Kerr | 141/348 |
| 3,673,762 | 7/1972 | Bock et al. | 53/86 |
| 4,648,432 | 3/1987 | Mechalas | 141/114 |
| 4,874,023 | 10/1989 | Ulm | 141/349 |

*Primary Examiner*—Henry J. Recla
*Assistant Examiner*—Steven O. Douglas
*Attorney, Agent, or Firm*—Henri J. A. Charmasson; John D. Buchaca

[57] ABSTRACT

A cylindrical plug made of elastomeric material is introduced into a cylindrical cartridge. The rim of the cartridge is swagged-in to reduce the diameter of its opening to one-third of the cartridge internal diameter and of the closely matching plug external diameter. The cartridge is held in a chamber. A tube slidingly passing through the wall of the chamber comes in contact with the plug, and holds it within the container while the chamber is filled with a highly pressurized fluid. As the cartridge is filled with the pressurized fluid the plug is tightly held against the internal end of the tube. The tube is partially withdrawn drawing the plug against the swagged opening of the cartridge. As the tube continues to be withdrawn its internal open end is separated from the plug, and pressurized fluid begins escaping through the tube indicating that the cartridge is filled. The pressurized fluid can now be evacuated from the chamber. A central part of the plug bulging through the swagged aperture provides a positive indication that the cartridge is fulled and tightly loaded.

11 Claims, 2 Drawing Sheets

GAS CAPSULE FILLING AND SEALING PROCESS

FIELD OF THE INVENTION

This invention relates to high pressure containers, and more specifically to the loading and sealing of high pressure gas cartridges.

BACKGROUND OF THE INVENTION

Cartridges of highly pressurized gas are used in certain high power staple guns, nail drivers and other similar tools. They are also commonly used to inflate airbags on vehicles, and as a propellant in certain non-lethal weapons. This type of cartridge usually comprises a cylindrical casing with a length of 30 millimeters (1.2 inch), and a diameter of 6 millimeters (0.24 inch). The walls of the cartridge or at least one of its ends is thin enough to be easily punctured in order to release the pressurized gas.

The loading and sealing of such a cartridge is particularly problematic when the contents is pressurized around or above 70 Atmospheres (1,030 psi). One of the most advanced methods taught by the prior art consists in soldering together two sections of the cartridge filled with the pressurized fluid, then evacuating the chamber to retrieve the loaded cartridges. Typically, the presoldered overlapping sections of the separate portions of the cartridges are brought together in the pressurized atmosphere then heated by some induction process to melt the solder, and left to cool down before the high pressure chamber is evacuated.

In the first place, this process can not be practiced when the fluid content is pressurized to a liquid form. Secondly, the soldering may be affected by the expansion and constriction of part of the fluid around the solder-heating process, resulting in leakage or weak soldering points. Moreover, there is no practical way to verify that indeed the cartridge is properly sealed, and that no fluid has escaped during the chamber evacuation process. Similarly, there is no practical way to verify that the pressure is maintained during the life of the cartridge and that the fluid has not slowly leaked out through imperfections in the soldered interface.

While the loading of a defective cartridge in a staple gun may have little consequences, the use of a defective cartridge in an automobile airbag or a weapon may have disastrous consequences.

The present invention results from a quest for a more effective and safe process to package a highly pressurized fluid into a small cartridge.

SUMMARY OF THE INVENTION

The principal and secondary objects of this invention are to provide a safe, practical, and dependable method for packaging small volumes of highly pressurized gas into cartridges such as those used in connection with staple guns, air guns, safety airbags, and some non-lethal weapons; and to provide a convenient way to verify the integrity of the loaded cartridge after long periods of storage.

These and other objects are achieved by placing a cartridge into which has been introduced a cylindrical plug matching the inner diameter of the cartridge and made of an elastomeric material into a high pressure chamber after having swagged the open end of the cartridge to reduce its aperture, then admitting the pressurized fluid into the chamber while keeping the plug away from the cartridge aperture by means of a tubular shaft passing through a wall of the chamber and pressing against the plug. As the pressure inside the chamber increases filling the cartridge, the section of the plug contacted by the tubular shaft adheres firmly to the shaft closing its internal channel. Once the desired pressure has been reached into the chamber, the tubular shaft is partially withdrawn to draw the plug against the cartridge aperture. Further withdrawing of the tubular shaft breaks the bond between its end and the plug, allowing some fluid to escape through the central channel of the tubular shaft outside the chamber. This is a positive indication that the cartridge is fully loaded, and that the chamber can be evacuated. The slight out-bulging of the plug through the cartridge aperture is a positive indication of its pressurized status throughout the life of the cartridge.

DESCRIPTION OF THE PREFERRED EMBODIMENT OF THE INVENTION

Figure 1:
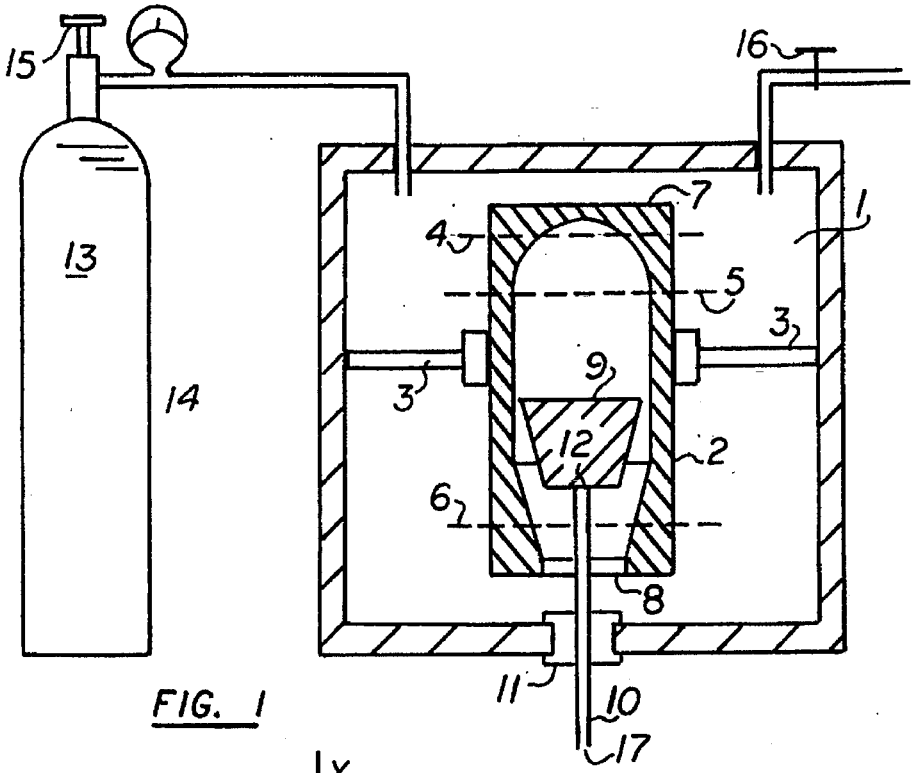
FIG. 1 is a diagrammatical illustration of the pressurized fluid packaging process.

Referring now to the drawing, there is shown in FIG. 1 a pressure chamber 1 within which a vessel 2 to be filled with a pressurized fluid is being held by a clamping mechanism 3 connected to at least one wall of the chamber. The vessel 2 has a plurality of circular cross-sections 4,5, and 6, a closed end 7, and an opposite open end defining an aperture 8. The aperture 8 is smaller than at least the largest cross-section 4. The vessel contains a plug 9 made of elastomeric material and having a plurality of circular cross-sections, at least one of which is larger than the aperture 8. A tubular shaft 10, slidingly passing through a hermetical seal 11 in a wall of the chamber 1, has an open end 12 in contact with the plug 9. A highly pressurized fluid 13 is admitted into the chamber 1 from a pressurized fluid source 14 by opening an intake valve 15 while an exhaust valve 16 is kept closed. The hollow shaft 10 is moved inwardly to keep the plug 9 away from the aperture 8. As the pressurized fluid fills the chamber, it also fills that portion of the vessel which is not occupied by the plug. The difference in pressure between the inside of the chamber and the outside ambient atmosphere where the opposite open end 17 of the tubular shaft is located causes the section of the plug in contact with the internal open end 12 of the tubular shaft to tightly adhere to that end and prevent any pressurized fluid from escaping through the central channel of the tubular shaft 10.

As the tubular shaft is partially withdrawn the plug is forced to move by the imbalanced pressure force acting on it and comes to rest against the opening 8 of the vessel, closing it. As the tubular shaft continues to be withdrawn, its internal open end 12 separates from the plug that is now immobilized into the opening of the vessel. Some of the pressurized fluid begins escaping through the internal channel of the tubular shaft indicating that the vessel is now full and sealed. The intake valve 15 is closed and the exhaust valve 16 open to evacuate the pressurized fluid from the chamber, and the loaded vessel can be retrieved.

Figure 2:
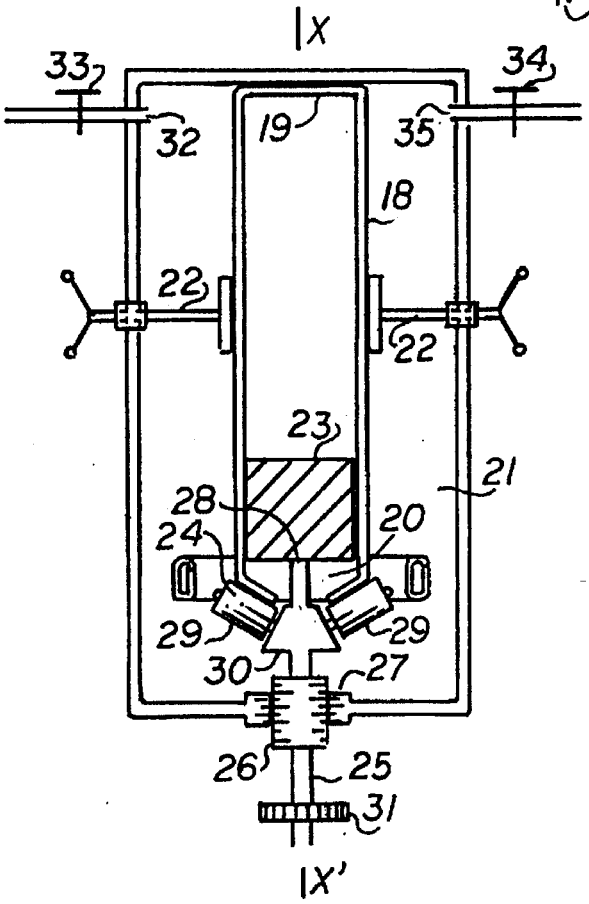
FIG. 2 is a cross-sectional illustration of an apparatus used to implement said process.
Figure 4:
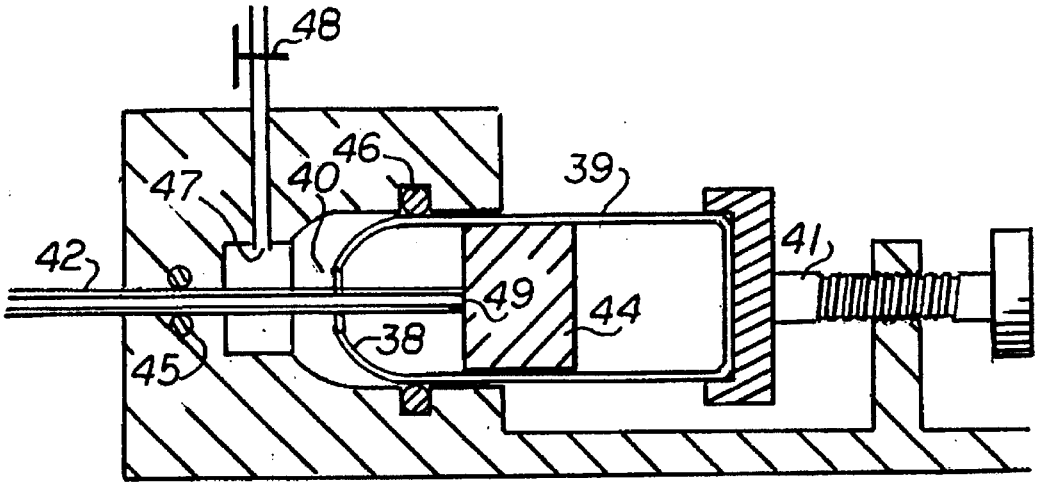
FIG. 4 is a cross-sectional view of an alternate embodiment of the invention.
Figure 3:
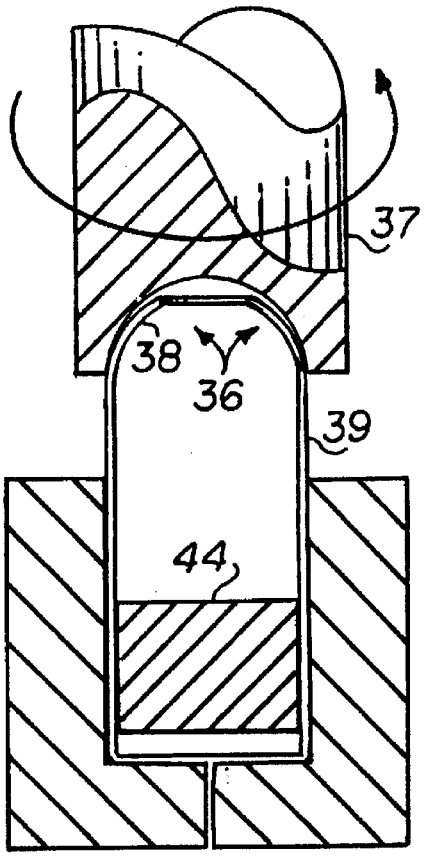
FIG. 3 is an illustration of a swagging process.

The preferred embodiment of the invention is illustrated in FIGS. 2, 3, and 4.

As shown in FIG. 2, a cylindrical cartridge 18 having a closed end 19 and an opposite open end 20 is held within a pressure chamber 21 by a clamping mechanism 22 having two clamping jaws anchored to opposite walls of the chamber. A cylindrical plug 23, made of elastomeric material and having a length approximately equal to its diameter which is approximately 0.75 millimeter (0.005 inch) less in diameter than the internal diameter of the cartridge, is inserted all the way into the cartridge. The open end 20 of the cartridge is then constricted by swagging-in the rim 24 of the cartridge to an angle between 30 and 80 degrees in reference to the axis of the cartridge. The swagging operation is accomplished by a mechanism comprising a tubular shaft 25 having a finely threaded section 26 meshing with a threaded bearing 27 coaxial with the cartridge. The distal end 28 of the tubular shaft extends into the cartridge to contact the plug 23. Two or more rollers 29 are mounted inside the chamber on a yoke 30 fixed to the tubular shaft proximate the cartridge aperture 20. The rollers are slanted to the desired swagging angle. The tubular shaft and roller mechanism are rotated clockwise through an external gear 31. As the tubular shaft slowly advances within the loaded cartridge, the roller 29 begins to bend the rim 24 of the cartridge inwardly until the diameter of the aperture 20 is reduced to about one-third of the internal diameter of the cartridge. At that point, a pressurized fluid is admitted through the intake port 32 by means of valve 33 while the valve 34 of the exhaust port 35 is kept shut. The pressurized fluid flows into the cartridge seeping between the plug 23 and the cartridge internal walls. As the pressure builds into the chamber the part of the plug contacted by the tubular shaft is pressed firmly against the latter. The tubular shaft 25 is then rotated counter-clockwise in a withdrawing movement which drags the plug 23 seats firmly against the swagged rim 24. As the tubular shaft 25 continues to withdraw, the bond between the plug and the distal end of the shaft 28 is broken, allowing some of the fluid to escape to the outside of the chamber via the internal channel of the tubular shaft. This is an indication that the cartridge has been fully loaded. The chamber is now evacuated by closing the intake valve 33 and opening the exhaust valve 34. The chamber 21 can now be opened to retrieve the loaded cartridge.

Figure 5:
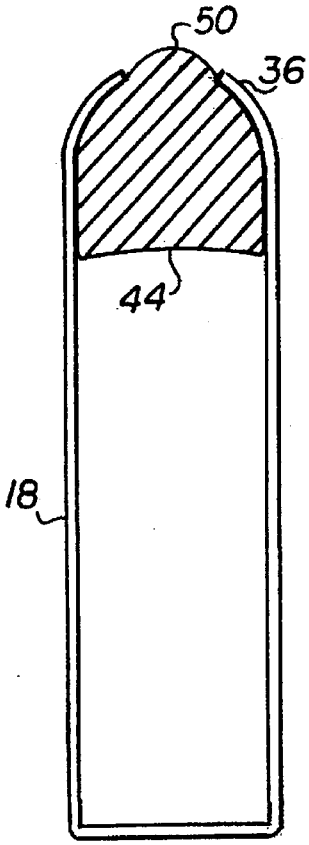
FIG. 5 is a cross-sectional view of a loaded cartridge.

In an alternate preferred embodiment of the invention illustrated in FIGS. 3, 4 and 5, the rim is swagged into a hemispherical configuration 36. The hemispherical shape, with an ever increasing angle of its surface to the axis of the cartridge, prevents the elastomeric plug from assuming a skewed orientation with the cartridge axis. The previously-described conical swagged end can cause the elastomeric plug to orient itself with one of its sides sliding down the side of the cone and resulting in an imperfect seal.

As shown in FIG. 3, the hemispherical swagging operation is accomplished by use of a concave hemispherically shaped steel die 37 being spun at high speed and forced down over the rim of the open end of the cartridge. The frictional heat and pressure of the spinning die produces a smooth, curved, crack-free reduction in the cartridge opening. The swagging is continued until the opening is reduced to a diameter approximately 40% to 50% of the original opening diameter.

As shown in FIG. 4, pressurization of the cartridge is accomplished by inserting the swagged end 38 of the cartridge 39 into a pressure chamber 40 and clamping the cartridge into position by means of clamping mechanism 41. A tubular shaft 42 is moved inward along the axis of the cartridge so that its distal end 28 extends into the cartridge and contacts the plug 44. The tubular shaft penetration into the pressure chamber is sealed by an O-ring 45. The cartridge penetration into the pressure chamber is sealed by another O-ring 46.

At that point, a pressurized fluid is admitted through the intake port 47 by means of valve 48. The pressurized fluid flows into the cartridges seeping past the plug 44. As the pressure builds into the chamber and cartridge, the central part of the plug is pressed against the end of the tubular shaft 42. The latter is then withdrawn until the plug seats firmly against the hemispherical rim 38. As the tubular shaft is further withdrawn, the bond between the plug and the distal end of the shaft 49 is broken, allowing some of the fluid to escape to the outside of the chamber via the internal channel of the tubular shaft.

As in the previously-described embodiment, this is an indication that the cartridge is fully filled. The chamber is now evacuated by closing the intake valve 48 and allowing the fluid to escape out through the tubular shaft. The clamp 41 can now be released to free the cartridge.

FIG. 5 illustrates a loaded cartridge where the top of the plug 44 has been deformed under the push of the internal pressurized fluid to follow the internal contour of the hemispherically swagged rim 36, and to form a central bulging section 50. That bulging section is a positive indication during the shelf-life of the cartridge that it maintains its internal pressure.

The cartridge is preferably made of a metal or alloy with a ductility falling between the ductility of copper and that of stainless steel such as brass. The thickness of the cartridge wall is approximately 0.3 millimeter (0.012 inch). The plug 49 is made by cutting small sections of a rod of an elastomeric material having a specific weight of about 2 such as a Viton brand of elastomers.

The cartridge can also be manufactured by molding a thermo-plastic material. In such case a heating element may be used around the rim of the cartridge to mollify it during the swagging process.

It should be understood that the mechanisms described in FIGS. 2, 3 and 4 do not limit the way of practicing the invention. The swagging and filling process can be accomplished at separate stations in an assembly line operation.

Figure 6:
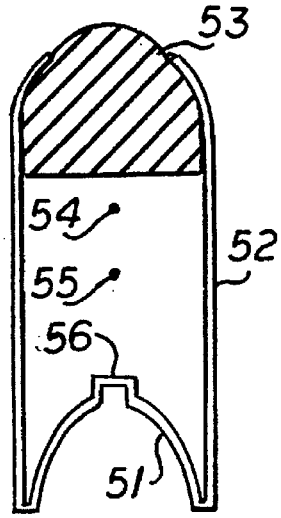
FIG. 6 is a cross-sectional view of a second alternate embodiment of the invention.

A second alternate embodiment of the invention is shown in FIG. 6. Here the back of closed end 51 of the cartridge 52 has been concavely formed in the bell-shape of the diverging section of a supersonic nozzle. In addition, the elastomers plug 53 includes heavy materials to increase its density. These materials may be in the form of high density particles (e.g., lead) molded into the elastomers or a single weight molded into the elastomers to increase its average density. The corresponding average specific gravity of the elastomeric plug is then increased to approximately 5 or greater and is used to assure that the center of gravity 54 of the entire cartridge is substantially forward of the center of the drag 55.

When the cartridge is mounted in a rifle-type mechanism and the entrance 56 of the nozzle 51 is punctured by an external pin, fluid enclosed in the cartridge will be expelled from the cartridge and drive the entire cartridge as a self-propelled projectile.

While the preferred embodiments of the invention have been described, modifications can be made and other embodiments may be devised without departing from the spirit of the invention and the scope of the appended claims.

What is claimed is:

1. A method for packaging a volume of pressurized fluid which comprises the steps of:

selecting a vessel having substantially circular internal cross-sections and a single aperture smaller than the largest of said cross-sections, said vessel containing a plug made of elastomeric material and having substantially circular external cross-sections, at least one of said plug cross-sections being larger than said aperture and smaller than said vessel largest cross-section;

exposing said aperture to a source of said pressurized fluid by placing said vessel in a chamber and filling said chamber with said pressurized fluid while holding said plug spaced apart from said aperture;

placing said plug in closing contact with said aperture; and removing said source of pressurized fluid from said aperture.

2. The method of claim 1, wherein said step of holding said plug comprises:

contacting said plug with a first open end of a tubular shaft, said shaft having an opposite second open end outside said chamber, and a portion slidingly and hermetically passing through a wall of said chamber;

whereby a pressure difference between the inside and outside of the chamber causes a section of said plug contacted by said shaft to tightly close said first open end.

3. The method of claim 2, wherein said step of contacting said plug comprises partially withdrawing said shaft from said chamber until said plug rests against said aperture.

4. The method of claim 3, wherein said step of removing said source comprises evacuating said pressurized fluid from said chamber.

5. The method of claim 4, wherein said step of selecting a vessel comprises the steps of:

using a cylindrical vessel having a closed end, an opposite open end defining said aperture, and a substantially constant internal cross-section and diameter;

introducing into said vessel a length of cylindrical plug having a cross-section intimately matching said vessel internal cross-section; and deforming a rim section surrounding said open end to reduce said aperture.

6. The method of claim 5, wherein said step of deforming comprises concentrically swagging said rim section inwardly.

7. The method of claim 6, wherein said step of using comprises using a metallic vessel.

8. The method of claim 6, wherein said step of swagging comprises shaping said rim into a hemispherical configuration.

9. The method of claim 8 which further comprises concavely forming a central back section of said vessel closed end into a bell-shape.

10. The method of claim 5, wherein said step of deforming comprises reducing the diameter of said aperture to about two-fifths of said vessel internal diameter.

11. The method of claim 5, wherein said step of using comprises using a vessel made of thermo-plastic; and the step of deforming comprises thermally reshaping said rim section.

* * * * *